US010953974B2

(12) United States Patent
Griffin et al.

(10) Patent No.: US 10,953,974 B2
(45) Date of Patent: Mar. 23, 2021

(54) STERN-MOUNTED LATERAL MARINE THRUSTER

(71) Applicant: Sideshift Inc., Carleton Place (CA)

(72) Inventors: Robert John Griffin, Carleton Place (CA); Réal Mark Houle, Carleton Place (CA)

(73) Assignee: Sideshift Inc., Carleton Place (CA)

( * ) Notice: Subject to any disclaimer, the term of this patent is extended or adjusted under 35 U.S.C. 154(b) by 0 days.

(21) Appl. No.: 16/412,345

(22) Filed: May 14, 2019

(65) Prior Publication Data

US 2020/0031449 A1 Jan. 30, 2020

(30) Foreign Application Priority Data

Jul. 20, 2018 (CA) ..... 3012297
Sep. 20, 2018 (CA) ..... 3016529

(51) Int. Cl.
*B63H 25/42* (2006.01)
*B63H 1/16* (2006.01)
*B63H 20/02* (2006.01)

(52) U.S. Cl.
CPC ..... *B63H 25/42* (2013.01); *B63H 1/16* (2013.01); *B63H 20/02* (2013.01)

(58) Field of Classification Search
CPC ..... B63H 25/00; B63H 25/42; B63H 25/46; B63H 1/00; B63H 1/16; B63H 20/00; B63H 20/02; B63H 5/00; B63H 5/14; B63H 5/15; B63H 21/00; B63H 21/17; B63H 23/00; B63H 23/24
USPC ..... 114/151; 440/6, 7, 40
See application file for complete search history.

(56) References Cited

U.S. PATENT DOCUMENTS 3,596,625 A * 8/1971 Guenther ..... B63H 20/007 440/6
5,016,553 A * 5/1991 Spencer ..... B63H 25/46 114/151
5,704,306 A * 1/1998 Den Ouden ..... B63H 5/14 114/151
6,435,120 B2 * 8/2002 Duncan ..... B63H 25/42 114/151
6,579,133 B1 * 6/2003 Harris ..... B63H 25/46 114/151
7,789,032 B1 * 9/2010 McDugle ..... B63H 25/46 114/151
10,202,181 B2 * 2/2019 Suzuki ..... B63H 5/14

* cited by examiner

*Primary Examiner* — Lars A Olson
(74) *Attorney, Agent, or Firm* — Patent Technologies, LLC; Robert D. Gunderman, Jr.

(57) ABSTRACT

A lateral marine thruster is disclosed for mounting to an outboard motor. The lateral marine thruster has a bi-directional thruster with a central body portion and at least one propeller, the central body portion housing at least one high torque electric motor, which is rotatably coupled to at least one propeller, the rotational axis of the high torque electric motor and the propeller being oriented perpendicular to the centerline of the outboard motor. The bi-directional thruster is secured to the anti-cavitation plate or a similar mounting location of the outboard motor to provide lateral thrust for ease of docking or mooring a vessel.

17 Claims, 6 Drawing Sheets

STERN-MOUNTED LATERAL MARINE THRUSTER

CROSS REFERENCE TO RELATED PATENT APPLICATION

This Application claims priority to Canadian Patent Application No. 3,012,297 filed on Jul. 25, 2018 and Canadian Patent Application No. 3,016,529 filed on Sep. 5, 2018 which are both incorporated herein by reference in their entirety as permissible by national or regional laws.

BACKGROUND OF THE INVENTION

1. Field of the Invention

The present invention relates to marine propulsion systems and navigational aids. More specifically, the present invention relates to lateral marine thrusters adapted for externally or integrally mounting to the stern of a vessel in order to facilitate lateral movement of the stern of the vessel in docking situations.

2. Description of the Related Art

Lateral marine thrusters are commonly employed on large open-water vessels (such as freighters, tankers, cruise liners and military ships) to assist with maneuvering these extremely large vessels in tight quarters when docking or navigating a harbor or narrow channel, for example.

Although such lateral marine thrusters are also employed on smaller vessels, suitable lateral propulsion systems can be rather complex thereby increasing the expense of including this feature during the initial construction of the vessel.

Moreover, it can also be difficult to mount an aftermarket lateral marine thruster to an existing vessel as this piece of equipment requires a suitable mounting location that must be carefully selected given that hydrodynamic or sea-worthiness concerns can be raised if the integrity of the vessel's external hull is compromised. This challenge can be exacerbated when trying to mount an aftermarket lateral marine thruster to the stern of a vessel with an outboard motor, as suitable mounting space can be quite limited.

Furthermore, a lateral marine thruster may not function ell for its intended purpose if it is not located in a sufficiently outboard (i.e.: distal) position, it will be appreciated that some lateral movement can be achieved by turning a stern-mounted motor nearly 90° from the vessel's centerline, however in order to provide bi-directional lateral movement two stern-mounted motors oriented in nearly opposing directions would be required and most motor mounts would not provide the clearance for this degree of rotational freedom of the motor. As such, using any existing stern-mounted motor(s) for achieving lateral movement of a boat's stern in close quarters is largely impractical.

As such, there are a number of limitations that must be considered when designing, manufacturing and installing a lateral marine thruster for aftermarket installation. Given that there are numerous hull shapes and sizes that must be taken into consideration, an effective lateral marine thruster will need to either be manufactured in a number of configurations or utilize an effective universal mounting scheme.

It will also be readily appreciated that an effective lateral marine thruster has certain performance requirements that are not easily met by other readily available propeller-based propulsion systems that could be mounted to small-to-medium sized vessels in aftermarket applications. One such example of an unsuitable lateral marine thruster is a traditional outboard trolling motor, which can be designed to operate on fuel or electricity and which is designed for relatively low powered, continuous operation and as such are wholly unsuited for the nearly instantaneous, high torque/high rpm/high power needs of lateral marine thruster applications.

For example, depending on the specific end-user application a suitable lateral marine thruster may need to be truly bi-directional in operation, electrically powered, provide nearly instantaneous high torque at high rotational speeds, be manufactured in a sufficiently robust manner and lit within a housing or mounting arrangement in a generally hydrodynamic manner.

Therefore, there is a need for a lateral marine thruster that can be readily-mounted to a wide variety of vessels in a suitable location without compromising the vessel's seaworthiness or hydrodynamic performance and which provides the required thrust and navigational performance to effectively provide lateral thrust in order to aid with docking and maneuvering the vessel in close quarters.

BRIEF SUMMARY OF THE INVENTION

In accordance with the present invention, there is provided a stern-mourned lateral marine thruster that can be readily-mounted (either externally or integrally) to a wide variety of vessels in a suitable location without compromising the vessel's seaworthiness or hydrodynamic performance and which provides the required thrust and navigational performance to effectively provide lateral thrust in order to aid with docking and maneuvering the vessel in close quarters.

In at least one embodiment, the present invention provides a lateral marine thruster assembly for to mounting to an outboard motor, the lateral marine thruster having a bi-directional thruster having a central body portion and at least one propeller, the central body portion housing at least one high torque electric motor, the at least one high torque electric motor rotatably coupled to the at least one propeller, the rotational axis of the at least one high torque electric motor and the at least one propeller being oriented perpendicularly to the centerline of the outboard motor and means for securing the bi-directional thruster to the outboard motor.

In another embodiment, the present invention provides a lateral marine thruster and outboard motor assembly having a bi-directional thruster having a central body portion and at least one propeller, the central body portion housed in a thruster housing, the thruster housing defining a transverse cylindrical bore, the thruster housing integrally joined with an external housing of an outboard motor, the central body portion housing rotatably coupled to the at least one propeller, the at least one propeller rotatably coupled to at least one high torque electric motor, the rotational axis of the at least one propeller being oriented perpendicularly to the centerline of the outboard motor.

The foregoing has been provided by way of introduction, and is not intended to limit the scope of the invention as described by this specification, claims and the attached drawings.

BRIEF DESCRIPTION OF THE DRAWINGS

The invention will be described by reference to the following drawings, in which like numerals refer to like elements, and in which.

Figure 1:
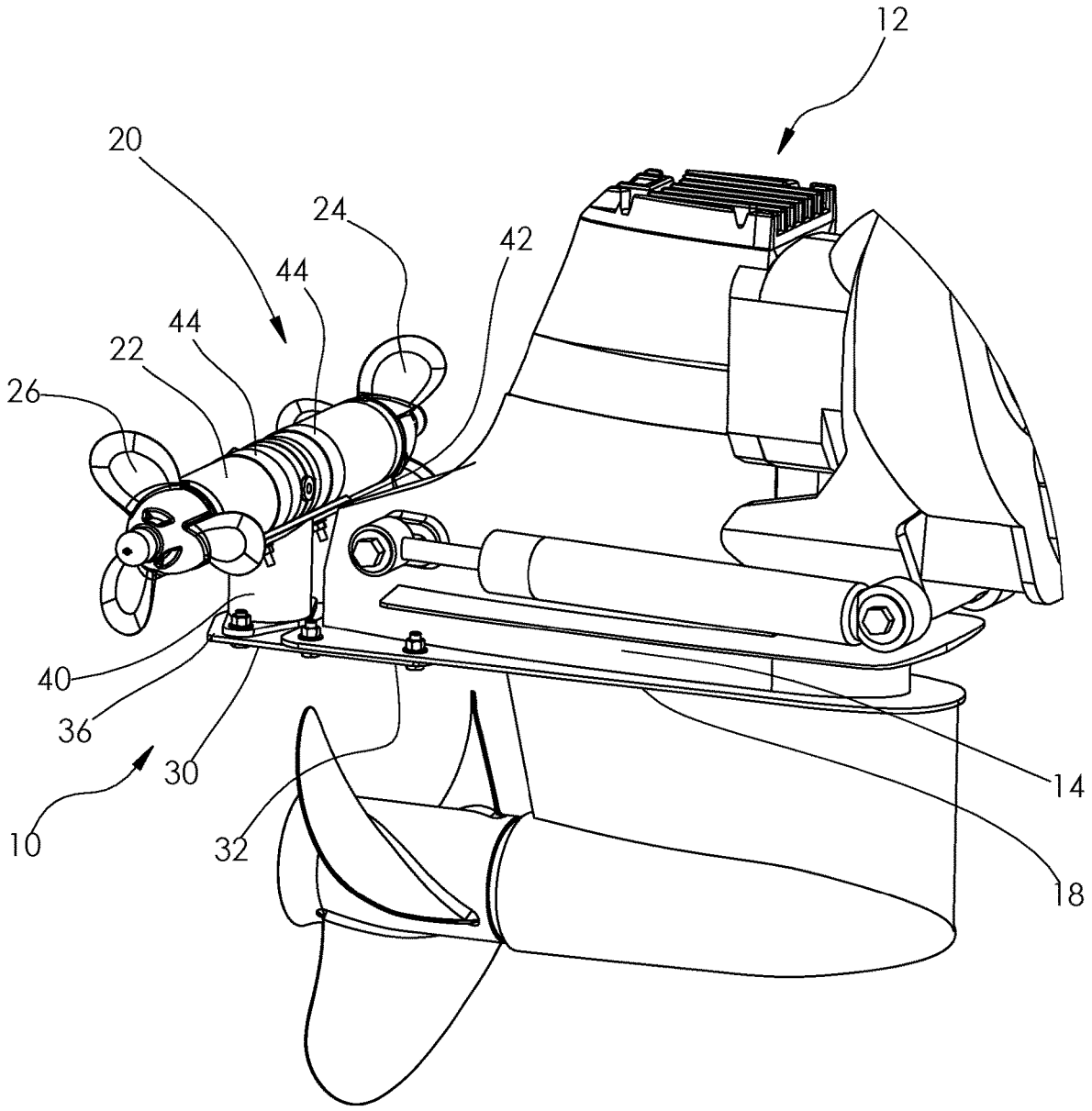
FIG. 1 is a perspective view of one embodiment of a lateral marine thruster assembly mounted to an outboard motor in accordance with the present invention.

The present invention will be described in connection with a preferred embodiment, however, it will be understood that there is no intent to limit the invention to the embodiment described. On the contrary, live intent is to cover all alternatives, modifications, and equivalents as may be included within the spirit and scope of the invention as defined by this specification, claims, and drawings attached hereto.

DESCRIPTION OF THE PREFERRED EMBODIMENTS

It is provided that the present invention can provide an aftermarket, stern-mounted lateral marine thruster that can be readily-mounted to a wide variety of vessels in a suitable location without compromising the vessel's seaworthiness or hydrodynamic performance and which provides the required thrust and navigational performance to effectively provide lateral thrust in order to aid with docking and maneuvering the vessel in close quarters. In other embodiments, the present stern-mounted lateral marine thruster can be housed integrally within the housing of an outboard motor or stern drive motor.

It will be readily provided that the present invention can be manufactured out of any suitable material (including but not limited to various steels, alloys, aluminum, polymers and carbon fibers) and that the present invention can be formed of a single unitary component or multiple components that are suitably joined together by any number of suitable joining methods including welding, mechanical fasteners, adhesives, interfitting connections, among any other suitable joining methods that will be readily understood by the skilled person.

It will also be appreciated that all components discussed herein are adapted for operation and maintenance in a harsh marine environment and may be coaled or painted with suitable anti-corrosion and anti-fouling coatings as the particular end-user application may require.

It will also be readily appreciated that the present invention can be manufactured by any suitable manufacturing method (including but not limited to casting, milling, welding and forming) and can be arranged in any suitable size as required by the end-user application of the present invention.

In at least one embodiment, the present invention can provide a lateral marine thruster assembly for mounting to the stern of a boat. In some embodiments, it is particularly provided that a lateral marine thruster assembly in accordance with the present invention will be mounted to an outboard motor or stern drive motor that is present on a vessel. In other embodiments, it is provided that a lateral marine thruster assembly in accordance with the present invention will be mounted within a housing integrally formed with the external housing of an outboard motor or stern drive motor that is present on a vessel. As will be appreciated by the skilled person, a suitable external housing of an outboard motor or stern drive motor can take any suitable shape and can be manufactured out of any suitable materials.

In the context of the present invention, it will be readily appreciated that an "outboard" motor is to be considered effectively analogous to a stern drive motor, trolling motor, inboard motor or any other suitable marine motor that will be readily appreciated by the skilled person and as such these terms can be used interchangeably throughout the present specification.

In one embodiment, the lateral marine thruster assembly includes a bi-directional thruster having a central body portion and at least one propeller. The central body portion can take a number of suitable shapes (including a transversely oriented cylinder) and is adapted to house at least one high torque electric motor that is rotatably coupled to the at least one propeller.

In some embodiments it is provided that the propeller is located outside the central body portion while in other embodiments it is provided that the propeller could be housed within the central body portion, in these embodiments making the propeller an "impeller". It is also provided that the propeller can take any number of suitable forms with respect to blade number, blade pitch and any other variable propeller design aspects that will be readily appreciated by the skilled person.

As will be discussed herein, it is provided that in some embodiments the at least one propeller is a single propeller and the at least one high torque electric motor is a single reversible high torque electric motor, while in other embodiments it is provided that the at least one propeller is a first propeller and a second propeller that are each rotatably coupled to a respective first high torque electric motor and a second high torque electric motor, among other arrangements that will be readily appreciated by the skilled person.

It is provided that a suitable high torque electric motor will provide nearly instantaneous torque at high rotational speeds so that a large amount of thrust can be generated in a very short period of time. It is provided that a suitable electric motor may have a range of horsepower, can be brushed or brushless, can include a permanent magnet in its housing and will be adapted for operation and maintenance in a harsh marine environment, as will be readily appreciated by the skilled person.

In at least one embodiment, it is provided that the rotational axis of the at least one high torque electric motor and the at least one propeller is oriented generally perpendicularly to the centerline of the outboard motor that the entire assembly is mounted to.

In some embodiments, it is provided that the present lateral marine thruster assembly is mounted to a housing that is integrally formed within the external housing of an outboard motor. In these embodiments, the lateral marine thruster assembly has a thruster housing that is integrally formed within the external housing of an outboard motor that is in turn mounted to the stern of a vessel. In these embodiments, it is provided that the thruster housing defines a transversely oriented cylindrical bore that is adapted to receive a reversible thruster having a central body portion that is rotatably coupled to at least one propeller. Moreover, it is provided that at least one radial support spoke is provided to support the thruster housing in the radial direction.

Moreover, it is provided that in at least one embodiment means are provided for securing the bi-directional thruster to an outboard or stern drive motor. It is provided that such means can take a variety of forms and in one embodiment these means include a horizontal plate having a first end and a second end for securing the bi-directional thruster directly to the anti-cavitation plate of an outboard or stern drive motor.

It should be noted that the term anti-cavitation plate and cavitation plate are used interchangeably in much of the present day literature. As such, the term anti-cavitation plate as used herein is to be considered interchangeable with the term cavitation plate and variants thereof.

It will appreciated that the present bi-directional thruster can be secured directly to the anti-cavitation plate of an outboard or stern drive motor by a variety of means, including but not limited to a horizontal plate, a bracket, a clamp or any other suitable arrangement that will be readily understood by the skilled person.

It is further provided that these mounting mechanisms can be secured to the anti-cavitation plate by any suitable means including but not limited to mechanical fasteners, adhesives and interfitting components, among any other suitable arrangement that will be readily appreciated by the skilled person.

In these embodiments it is provided that the first end of the horizontal plate includes an inwardly projecting, generally symmetrical slot. In these embodiments, it is provided that this slot can receive the downwardly projecting driveshaft housing of the outboard motor and, in some embodiments, the horizontal plate can abut and be secured to either the upper surface or the lower surface of the anti-cavitation plate (alternatively known as the "anti-cavitation" or "anti-ventilation" plate or "cavitation" plate) of the outboard motor, as will be discussed in further detail herein.

It is further provided that the horizontal plate can include a number of vertically oriented bore or mounting holes that are positioned about the perimeter edge of the horizontal plate. In these embodiments, it is provided that the horizontal plate (and by extension, the entire lateral marine thruster assembly) can be directly secured to the anti-cavitation plate by way of a mechanical fastener (such as a nut and bolt assembly), however a number of suitable fastening means may be employed for securing the horizontal plate to the anti-cavitation plate as required by the specifies of the end-user application under consideration.

It is further provided that in some embodiments the second end of the horizontal plate includes a generally upwardly projecting pillar that, in some embodiments, can terminate in an upwardly facing concave surface. In some embodiments the upwardly facing concave surface further includes a cradle.

In these embodiments, it is provided that the central body portion of the bi-directional thruster is fixed directly to the upwardly facing concave surface by any suitable means. In some embodiments perimeter clamps can be provided to secure the central body portion to the upwardly facing concave surface, however other arrangements are also provided including suitable welds, mechanical components, interlining components or unitary construction techniques as will be readily understood by the skilled person.

In this way, it is provided that the present lateral marine thruster assembly is mounted perpendicularly and transversely relative to the outboard motor and, depending on the orientation of the outboard motor, can also be oriented perpendicularly and transversely to the centerline of the vessel.

As a result, the present invention can provide a lateral marine thruster assembly that can be readily and securely mounted to the anti-cavitation plate of an outboard motor so dial the bi-directional thruster is mounted above the anti-cavitation plate on the upwardly projecting pillar.

In this way, the present lateral marine thruster assembly is above the water line when the vessel is "on plane" that is, traveling at high speeds such that the vessel is primarily experiencing hydrodynamic lift, rather than hydrostatic lift. Therefore, the present lateral marine thruster assembly will not produce any undue hydrodynamic effects as it is located out of the water when the vessel is traveling at high speeds, as will be understood by the skilled person.

On the other hand, the present lateral marine thruster assembly will be completely submersed in water when the vessel is at rest or at low speeds. Therefore, the operator can use the present lateral marine thruster assembly in these situations to effectively move the stern of the boat laterally when required (typically, in close quarters or when docking).

Moreover, in some embodiments the operator can exert further control over the present lateral marine thruster assembly by pivoting the outboard motor while the present lateral marine thruster assembly is in operation, thereby permitting the operator to orient die present lateral marine thruster assembly on an axis that is not perfectly perpendicular to the centerline of the vessel if so required.

Turning to FIG. 1, one embodiment of the present invention is illustrated. In this embodiment, a lateral marine thruster assembly 10 is provided for mounting to an outboard motor 12 that is in turn mounted to the stern of a vessel.

In this embodiment, it is provided that the lateral marine thruster assembly 10 includes a bi-directional thruster 20 having a central body portion 22 and at least one propeller that in this embodiment is a first propeller 24 and a second propeller 26. In this embodiment, central body portion 22 is a transversely oriented cylinder and is adapted to house a first high torque electric motor and a second high torque electric motor (not shown) that are each respectively rotatably coupled to first propeller 24 and second propeller 26.

In this embodiment, it is provided that the rotational axis of the first high torque electric motor, the second high torque electric motor, the first propeller 24 and the second propeller 26 are all oriented generally perpendicular to the centerline of outboard motor 12 which the entire assembly 10 is mounted to. The centerline of the outboard motor 12 being defined by the direction of travel of the outboard motor 12 while in use with the vessel.

Moreover, it is provided that in this embodiment means are provided for securing bi-directional thruster 20 to the outboard motor 12. In this embodiment it is provided that such means include a horizontal plate 30 having a first end 32 and a second end 34 (see FIG. 2). The horizontal plate 30 may have an elongated geometry with a slot 36, where the slot 36 is U-shaped or otherwise confirms to a downwardly projecting driveshaft housing 14. In a similar manner, the horizontal plate 30 conforms or otherwise is similar to the geometry of the anti-cavitation plate 18 of the outboard motor. Mounting holes 31 or similar fastening structures traverse the perimeter or surface of the horizontal plate 30 to allow far drilling of the anti-cavitation plate and subsequent attachment of the horizontal plate 30 to the anti-cavitation plate 18. A pillar 40 or similar support structure can be seen that is cylindrical, tapered, or otherwise formed to attach the bi-directional thruster 20 to the mounting plate 30 which is in turn attached to the anti-cavitation plate 18 or a similar mounting location.

Figure 2:
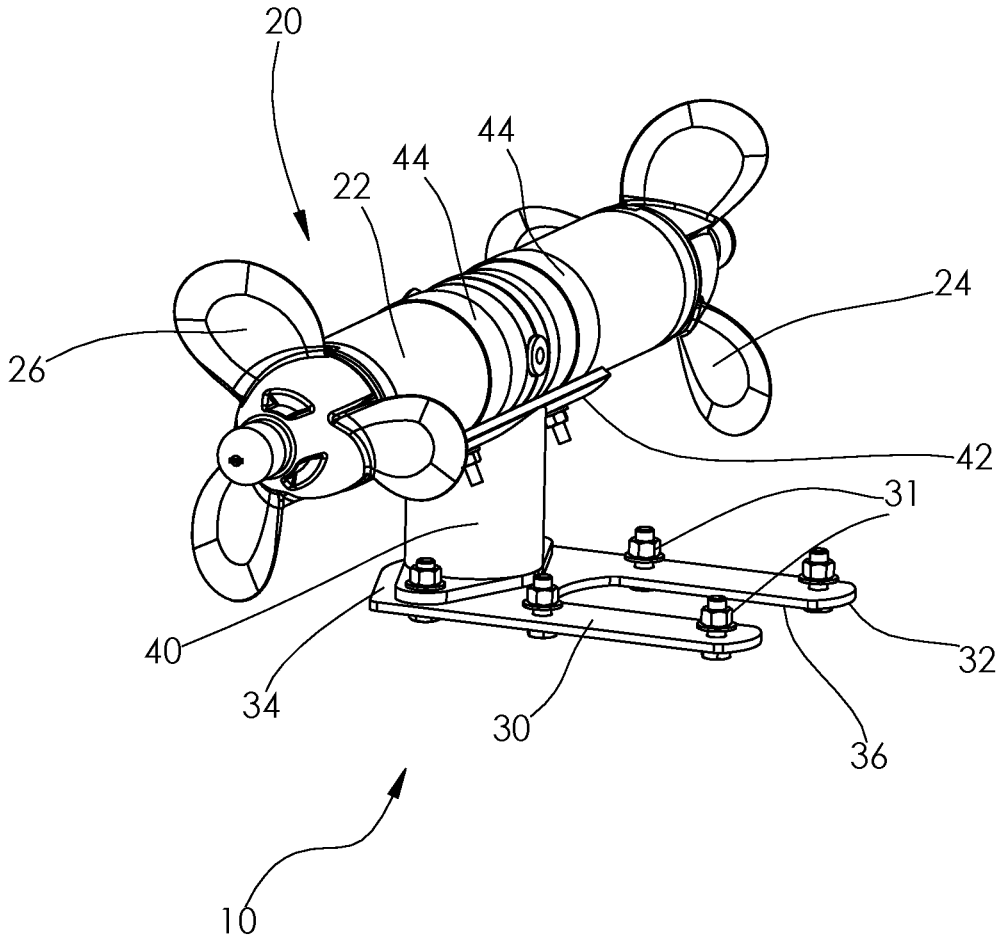
FIG. 2 is a perspective view of the lateral marine thruster assembly as shown in FIG. 1.

With reference to FIGS. 1 and 2, in these embodiments it is provided that first end 32 of horizontal plate 30 includes an inwardly projecting, generally symmetrical slot 36. In these embodiments, it is provided that slot 36 can receive the downwardly projecting driveshaft housing 14 of outboard motor 12, and horizontal plate 30 can be secured to the anti-cavitation plate 18 of outboard motor 12.

It is further provided that horizontal plate 30 includes a number of vertically oriented bore or mounting holes 31 that are positioned about the perimeter of the horizontal plate 30. In this embodiment, it is provided that horizontal plate 30 (and by extension, the entire lateral marine thruster assembly 10) is secured to the anti-cavitation plate 18 by way of a number of mechanical fasteners, such as nut and bolt assemblies.

It is further provided that second end 34 of horizontal plate 30 includes an upwardly projecting pillar 40 that terminates in an upwardly facing concave surface. In this embodiment, the upwardly facing concave surface is a cradle 42.

In this embodiment, it is provided that central body portion 22 of bi-directional thruster 20 is fixed to cradle 42 by way of perimeter clamps 44 which secure central body portion 22 to cradle 42.

In this way it is provided that lateral marine thruster assembly 19 is mounted transversely relative to outboard motor 12 and, depending on the rotational orientation of outboard motor 12, can also be oriented transversely to the centerline of the vessel.

As a result, the present invention provides a lateral marine thruster assembly that is readily and securely mounted to anti-cavitation plate 18 of outboard motor 12 so that bi-directional thruster 20 is mounted above anti-cavitation plate 18 on upwardly projecting pillar 40.

Figure 3:
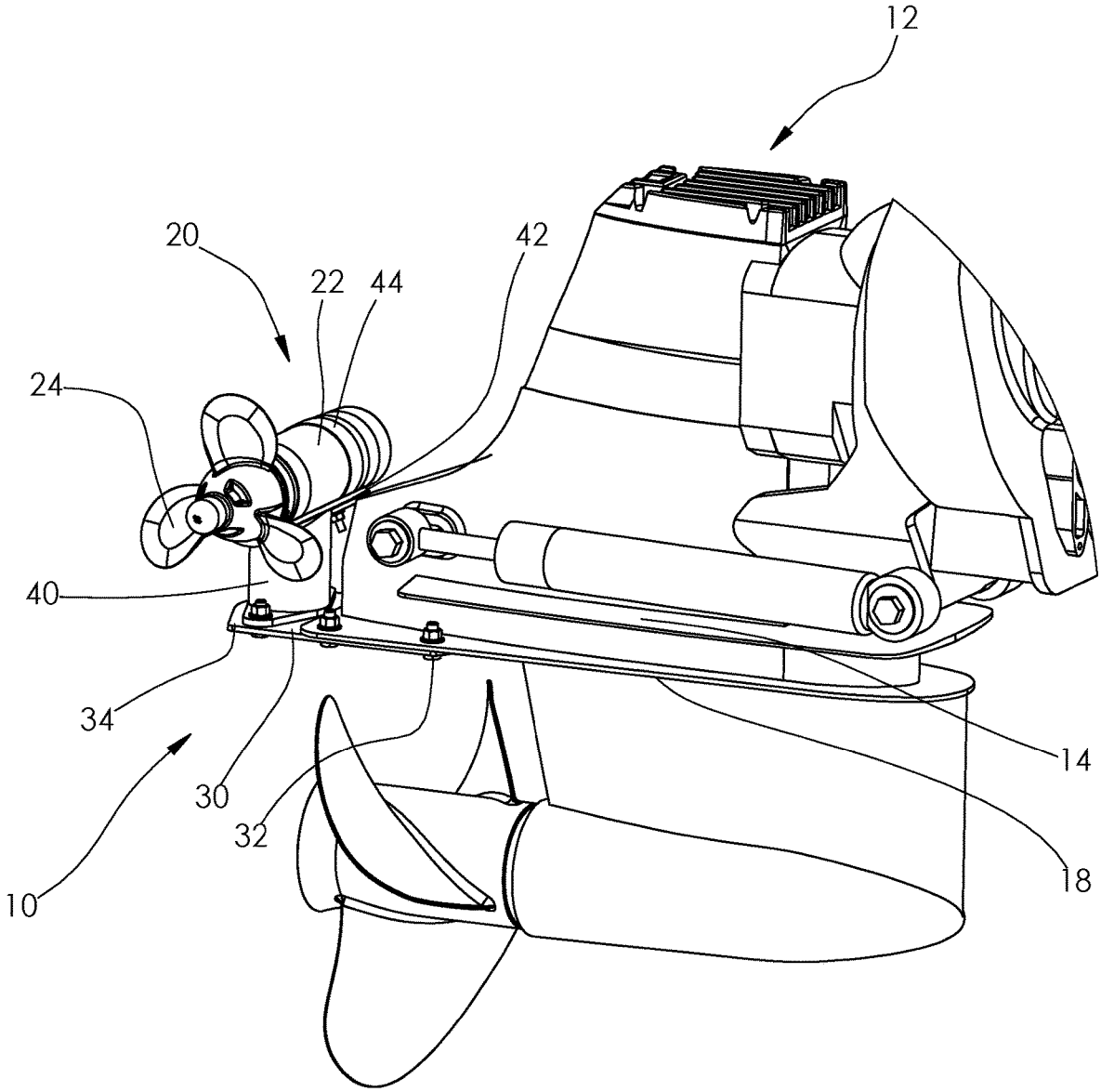
FIG. 3 is a perspective view of another embodiment of a lateral marine thruster assembly mounted to an outboard motor in accordance with the present invention.

Turning to FIG. 3, one embodiment of the present invention is illustrated. In this embodiment, a lateral marine thruster assembly 10 is provided for mounting to an outboard motor 12 that is in turn mounted to the stern of a vessel.

In this embodiment, it is provided that lateral marine thruster assembly includes a bi-directional thruster 20 having a central body portion 22 and at least one propeller that is a first propeller 24. In this embodiment, central body portion 22 is a transversely oriented cylinder and is adapted to house a first high torque electric motor (not shown) that is rotatably coupled to first propeller 24.

In this embodiment, it is provided that the rotational axis of first high torque electric motor, and first propeller 24 are oriented generally perpendicularly to the centerline of outboard motor 12 that the assembly 10 is mounted to.

Moreover, it is provided that in this embodiment means are provided for securing bi-directional thruster 20 to outboard motor 12. In this embodiment it is provided that such means include a horizontal plate 30 having a first end 32 and a second end 34.

Figure 4:
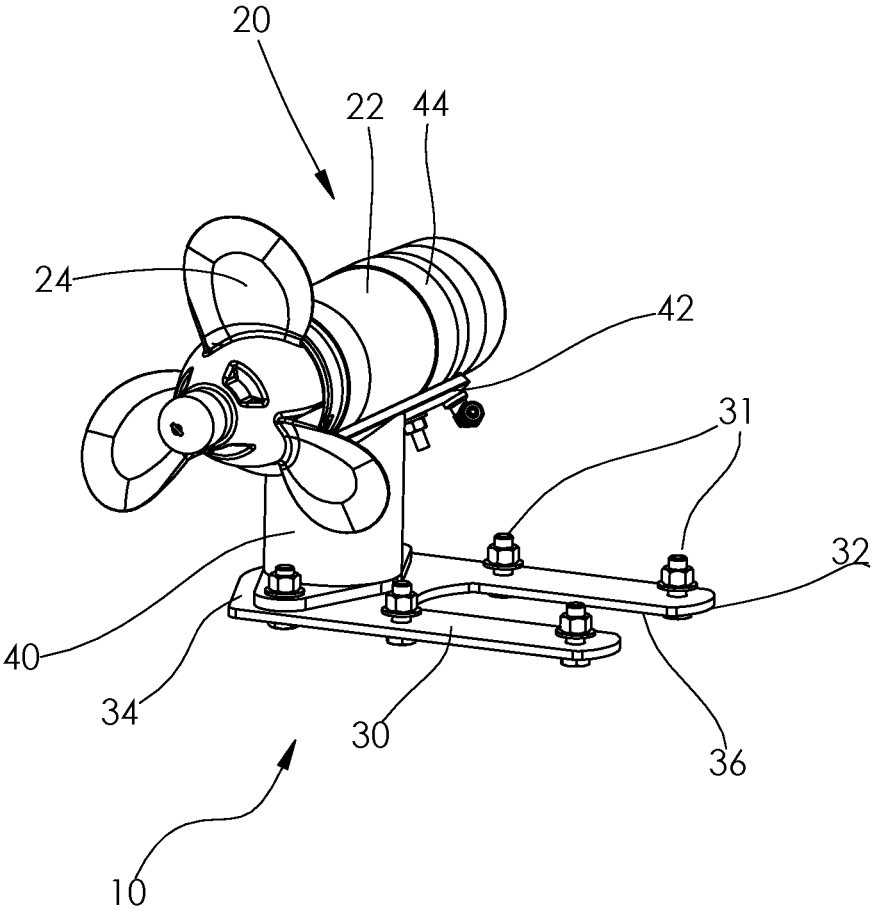
FIG. 4 is a perspective view of the lateral marine thruster assembly as shown in FIG. 3.

With reference to FIGS. 3 and 4, in these embodiments it is provided that first end 32 of horizontal plate 30 includes an inwardly projecting, generally symmetrical slot 36. In these embodiments, it is provided that slot 36 can receive the downwardly projecting driveshaft housing 14 of outboard motor 12 and horizontal plate 30 can be directly secured to the anti-cavitation plate 18 of outboard motor 12.

It is further provided that horizontal plate 30 includes a number of vertically oriented bore or mounting holes 31 that are positioned about the perimeter edge of the horizontal plate 30. In this embodiment, it is provided that horizontal plate 30 (and by extension, the entire lateral marine thruster assembly 10) is directly secured to anti cavitation plate 18 by way of a number of mechanical fasteners, such as nut and bolt assemblies.

It is farther provided that second end 34 of horizontal plate 30 includes an upwardly projecting pillar 40 that terminates in an upwardly facing concave surface. In this embodiment, the upwardly facing concave surface is a cradle 42.

In this embodiment, it is provided that central body portion 22 of bi-directional thruster 20 is fixed directly to cradle 42 by way of perimeter clamps 44 which secure central body portion 22 to cradle 42.

In this way it is provided that lateral marine thruster assembly 10 is mounted transversely relative to outboard motor 12 and, depending on the rotational orientation of outboard motor 12, can also be oriented transversely to the centerline of the vessel.

As a result, the present invention can provide a lateral marine thruster assembly that is readily and securely mounted to anti-cavitation plate 18 of outboard motor 12 so that bi-directional thruster 20 is mounted above anti-cavitation plate 18 on upwardly projecting pillar 40.

Figure 5:
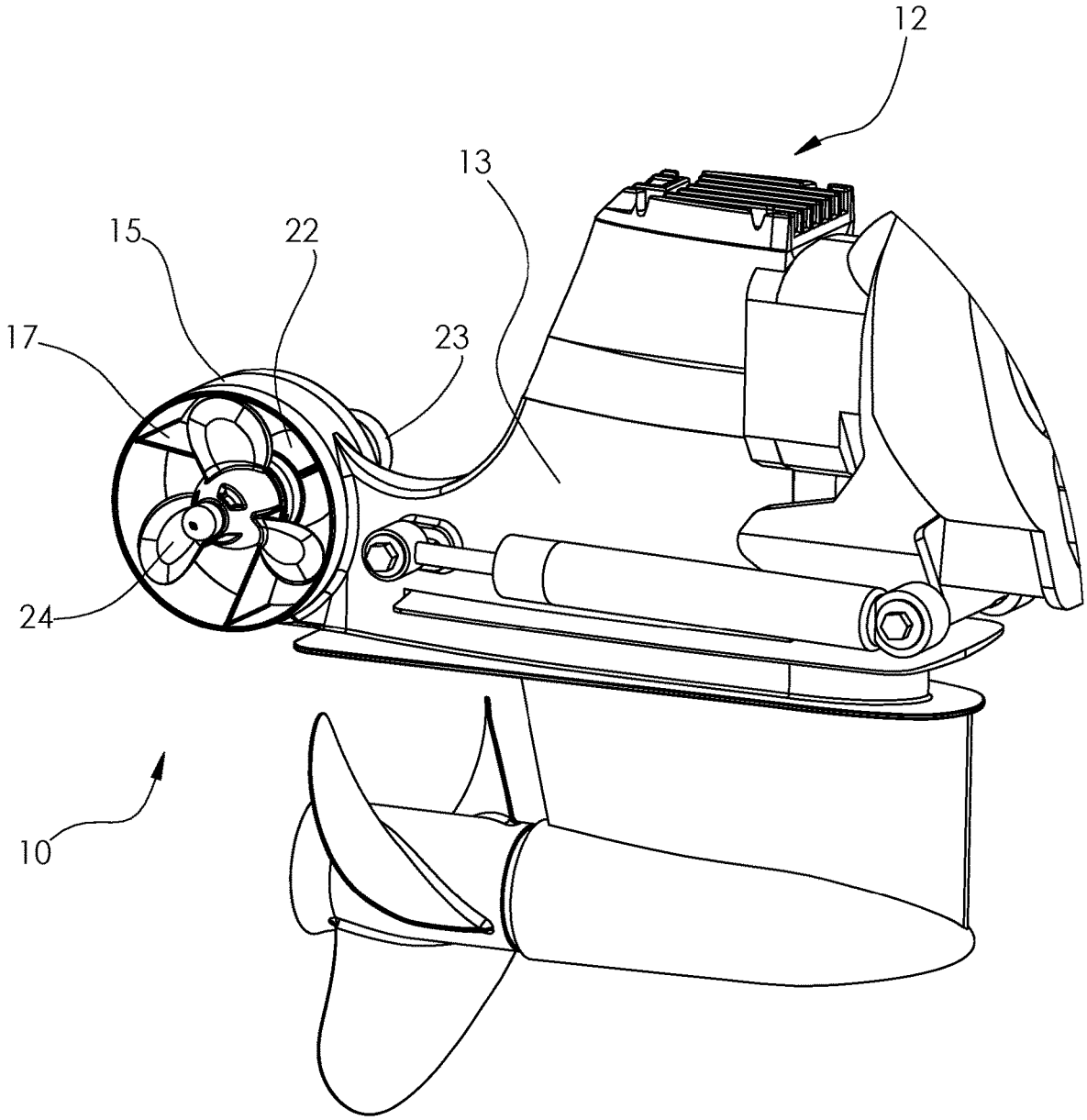
FIG. 5 is a perspective view of another embodiment of a lateral marine thruster assembly integrally mounted to an outboard motor in accordance with the present invention.

With reference to FIG. 5, another embodiment of the present invention is illustrated wherein the lateral marine thruster assembly is mounted to a housing that is integrally formed with the external housing of an outboard motor. In this embodiment, lateral marine thruster assembly 10 is provided having a thruster housing 15 that is integrally thrilled with the external housing 13 of an outboard motor 12 that is in turn mounted to the stern of a vessel. In this embodiment, it is provided that thruster housing 15 defines a transversely oriented cylindrical bore that is adapted to receive a reversible thruster having a central body portion 22 that is rotatably coupled to at least one propeller that in this embodiment is a reversible propeller 24. Moreover, it is provided that at least one radial support spoke 17 is provided to support thruster housing 15 in the radial direction. In this embodiment, central body portion 22 also houses a high torque electric motor 23 that is rotatably and reversibly coupled to reversible propeller 24. As will be readily understood by the skilled person, it is provided that high torque electric motor 23 is rotatably and reversibly coupled to reversible propeller 24 by any known means.

In this embodiment, it is provided that the rotational axes of reversible propeller 24 and high torque electric motor 23 are oriented generally perpendicular to the centerline of outboard motor 12; however other arrangements are also provided as will be appreciated by the skilled person.

Figure 6:
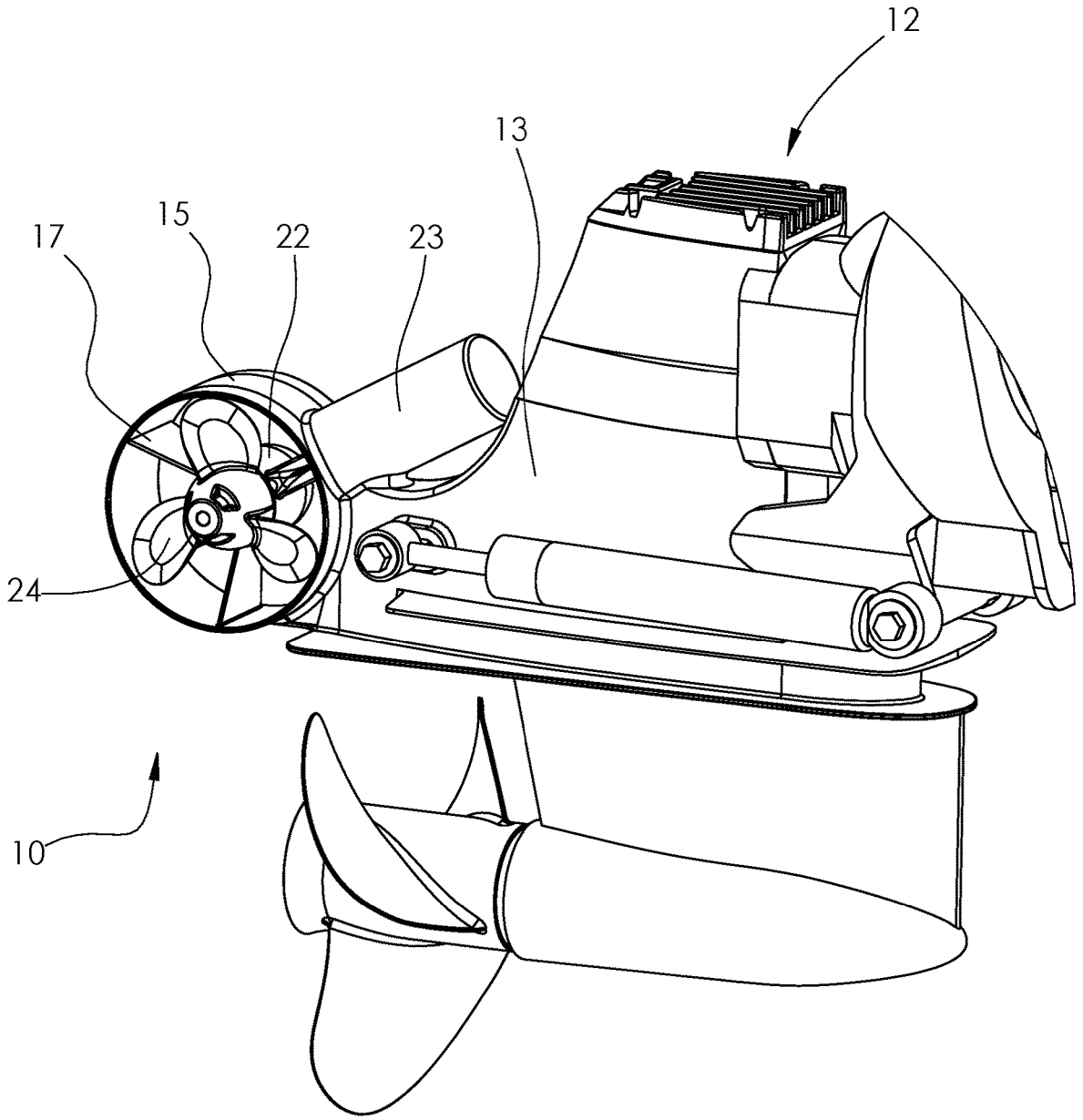
FIG. 6 is a perspective view of another embodiment of a lateral marine thruster assembly integrally mounted to an outboard motor in accordance with the present invention.

With reference, to FIG. 6, another embodiment of the present invention is illustrated wherein the lateral marine thruster assembly is mounted to a housing that is integrally formed with the external housing of an outboard motor. In this embodiment, lateral marine thruster assembly 10 is provided having a thruster housing 15 that is integrally formed with the external housing 13 of an outboard motor 12 that is in turn mounted to the stern of a vessel. In this embodiment, it is provided that thruster housing 15 defines a transversely oriented cylindrical bore that is adapted to receive a reversible thruster having a central body portion 22 rotatably coupled to at least one propeller that in this embodiment is a reversible propeller 24. Moreover, it is provided that at least one radial support spoke 17 is provided to support thruster housing 15 in the radial direction. In this embodiment, a high torque electric motor 23 is provided that is rotatably and reversibly coupled to reversible propeller 24. As will be readily understood by the skilled person, it is provided that high torque electric motor 23 is rotatably and reversibly coupled to reversible propeller 24 by any known means.

In this embodiment, it is provided that the rotational axis of reversible propeller 24 is oriented generally perpendicular to the centerline of outboard motor 12 and the rotational axis of high torque electric motor 23 is oriented vertically co-planar to the centerline of outboard motor 12, however other arrangements are also provided as will be appreciated by the skilled person.

In this way, the present lateral marine thruster assembly is above the water line when the vessel is "on plane" that is, traveling at high speeds such that the vessel is primarily experiencing hydrodynamic lift, rather than hydrostatic lift. Therefore, the present lateral marine thruster assembly will not produce any undue hydrodynamic effects as it is located out of the water when the vessel is traveling at high speeds.

On the other hand, the present lateral marine thruster assembly will be completely submersed in water when the vessel is at rest or at low speeds. Therefore, the operator can use the present lateral marine thruster assembly in these situations to effectively move the stern of the boat laterally when required (typically, in close quarters or when docking).

Moreover, it is provided that in some embodiments the operator can exert further control over the present lateral marine thruster assembly by pivoting the outboard motor while the present lateral marine thruster assembly is in operation, thereby permitting the operator to orient the present lateral marine thruster assembly on an axis that is not perfectly perpendicular to the centerline of the vessel.

The embodiments described herein are intended to be illustrative only and are not intended to limit the scope of the present invention. Various modifications and changes consistent with the description as a whole and which are readily apparent to the person of skill in the art are intended to be included. The appended claims should not be limited by the specific embodiments set forth in the examples, but should be given the broadest interpretation consistent with the description as a whole.

What is claimed is:

1. A lateral marine thruster for mounting to an outboard motor, the lateral marine thruster comprising:

a bi-directional thruster having a central body portion and at least one propeller, the central body portion housing at least one electric motor, the at least one electric motor rotatably coupled to the at least one propeller, the rotational axis of the at least one electric motor and the at least one propeller configured to orient perpendicularly to the centerline of the outboard motor when mounted to the outboard motor; and means for securing the bi-directional thruster to the outboard motor, the bi-directional thruster mounted to the means for securing the bi-directional thruster to the outboard motor in a fixed manner such that the rotational axis of the at least one electric motor and the at least one propeller is fixed perpendicularly relative to the centerline of the outboard motor when mounted to the outboard motor;

wherein the means for securing the bi-directional thruster to the outboard motor comprises a horizontal plate, the horizontal plate adapted to attach to an anti-cavitation plate of the outboard motor and having a first end and a second end, the first end having an inwardly projecting, generally symmetrical slot.

2. The lateral marine thruster of claim 1 wherein the horizontal plate further comprises a pillar projecting upwardly from an upper surface of the second end of the horizontal plate, the pillar having an upwardly concave surface that abuts and is secured to the central body portion of the bi-directional thruster.

3. The lateral marine thruster of claim 2 wherein the central body portion of the bi-directional thruster is secured to the upwardly concave surface of the pillar by way of at least one perimeter clamp.

4. The lateral marine thruster of claim 3 wherein the horizontal plate further comprises a plurality of vertical mounting holes positioned about the perimeter of the first end of the horizontal plate.

5. The lateral marine thruster of claim 1 wherein the at least one electric motor is reversible.

6. The lateral marine thruster of claim 1 wherein the at least one propeller is a first propeller and a second propeller and wherein the at least one electric motor is a first electric motor and a second electric motor, the first propeller being rotatably coupled the first electric motor, the second propeller being rotatably coupled the second electric motor, the first propeller and the second propeller being co-axially aligned in opposing directions.

7. The lateral marine thruster of claim 1 wherein the at least one electric motor is a brushed electric motor having a permanent magnet housing.

8. The lateral marine thruster of claim 1 wherein the central body portion further includes at least one vent.

9. An outboard motor comprising:

a bi-directional thruster having a central body portion and at least one propeller, the central body portion housing at least one electric motor, the at least one electric motor rotatably coupled to the at least one propeller, the rotational axis of the at least one electric motor and the at least one propeller configured to orient perpendicularly to the centerline of the outboard motor; and means for securing the bi-directional thruster to the outboard motor, the bi-directional thruster mounted to the means for securing the bi-directional thruster to the outboard motor in a fixed manner such that the rotational axis of the at least one electric motor ad the at least one propeller is fixed perpendicularly relative to the centerline of the outboard motor when mounted to the outboard motor;

wherein the means for securing the bi-directional thruster to the outboard motor comprises a horizontal plate, the horizontal plate adapted to attach to an anti-cavitation plate of the outboard motor and having a first end and a second end, the first end having an inwardly projecting, generally symmetrical slot.

10. The outboard motor of claim 9 wherein the at least one electric motor is reversible.

11. The outboard motor of claim 9 wherein the at least one propeller is a first propeller and a second propeller and wherein the at least one electric motor is a first electric motor and a second electric motor, the first propeller being rotatably coupled to the first electric motor, the second propeller being rotatably coupled to the second electric motor, the first propeller and the second propeller being co-axially aligned in opposing directions.

12. The outboard motor of claim 9 wherein the at least one electric motor is a brushed electric motor having a permanent magnet housing.

13. The outboard motor of claim 9 wherein the central body portion further includes at least one vent.

14. A lateral marine thruster for mounting to an outboard motor, the lateral marine thruster comprising:

a bi-directional thruster having a central body portion and at least one propeller, the central body portion housing at least one electric motor, the at least one electric motor rotatably coupled to the at least one propeller, the rotational axis of the at least one electric motor and the at least one propeller configured to orient perpendicularly and be fixed relative to the centerline of the outboard motor when mounted to the outboard motor;

a horizontal plate adapted to attach to an anti-cavitation plate of an outboard motor; and a pillar fixed between the horizontal plate and the central body portion of the bi-directional thruster.

15. The lateral marine thruster of claim 14, wherein the horizontal plate has a slot to receive a downwardly projecting driveshaft housing of the outboard motor.

16. The lateral marine thruster of claim 14, wherein the at least one electric motor is reversible.

17. The lateral marine thruster of claim 14, wherein the at least one propeller is a first propeller and a second propeller and wherein the at least one electric motor is a first electric motor and a second electric motor, the first propeller being rotatably coupled to the first electric motor, the second propeller being rotatably coupled to the second electric motor, the first propeller and the second propeller being co-axially aligned in opposing directions.

* * * * *